US008196651B2

(12) United States Patent
Murphy et al.

(10) Patent No.: US 8,196,651 B2
(45) Date of Patent: Jun. 12, 2012

(54) WELL BORE FLUID REDISTRIBUTION AND FLUID DISPOSAL IN WELLBORE ENVIRONMENTS

(75) Inventors: Raymond P. Murphy, Litchfield Park, AZ (US); Timothy G. Barritt, Upton, WY (US); Richard G. Stockdale, Cheyenne, WY (US)

(73) Assignee: Big Cat Energy Corporation, Upton, WY (US)

( * ) Notice: Subject to any disclaimer, the term of this patent is extended or adjusted under 35 U.S.C. 154(b) by 0 days.

(21) Appl. No.: 12/291,108

(22) Filed: Nov. 5, 2008

(65) Prior Publication Data

US 2010/0006294 A1 Jan. 14, 2010

Related U.S. Application Data

(63) Continuation of application No. 11/910,895, filed on Oct. 28, 2009, now abandoned, which is a continuation-in-part of application No. PCT/US2006/012789, filed on Apr. 5, 2006.

(60) Provisional application No. 60/668,896, filed on Apr. 5, 2005.

(51) Int. Cl.
*E21B 33/12* (2006.01)

(52) U.S. Cl. ..... 166/186; 166/316; 166/305.1; 166/54.1

(58) Field of Classification Search ..... 166/380, 166/54.1, 105, 126, 129, 133, 142, 146, 149, 166/180, 183–186, 188, 189
See application file for complete search history.

(56) References Cited

U.S. PATENT DOCUMENTS

| | | | | |
|---|---|---|---|---|
| 3,170,520 | A | 2/1965 | Arutunoff | |
| 3,363,692 | A * | 1/1968 | Bishop | 166/306 |
| 3,399,623 | A * | 9/1968 | Creed | 166/62 |
| 4,429,740 | A | 2/1984 | Malinchak | |
| 5,816,326 | A | 10/1998 | Slater | |
| 5,913,363 | A | 6/1999 | Paplinski | |
| 5,979,559 | A | 11/1999 | Kennedy | |
| 6,123,149 | A | 9/2000 | McKinzie et al. | |
| 6,325,143 | B1 | 12/2001 | Scarsdale | |
| 6,382,316 | B1 | 5/2002 | Kintzele | |
| 6,457,540 | B2 | 10/2002 | Gardes | |
| 6,745,855 | B2 | 6/2004 | Gardes | |
| 6,923,275 | B2 | 8/2005 | Gardes | |
| 7,216,720 | B2 * | 5/2007 | Zimmerman | 166/387 |

(Continued)

FOREIGN PATENT DOCUMENTS

CA 2196959 A1 8/1998

(Continued)

OTHER PUBLICATIONS

PCT Patent Application PCT/US2006/012789, filed Apr. 5, 2006.

(Continued)

*Primary Examiner* — Jennifer H Gay
*Assistant Examiner* — Yong-Suk Ro
(74) *Attorney, Agent, or Firm* — Craig R. Miles; CR Miles, P.C.

(57) ABSTRACT

Well bore fluid redistribution apparatuses which can be inserted into a well bore to isolate fluids produced in well bores from different geologic sections on either side of the apparatuses. Operation of the well bore fluid redistribution apparatuses can redistribute fluids produced in well bores between different geologic sections to reduce surface discharge of fluids.

11 Claims, 10 Drawing Sheets

U.S. PATENT DOCUMENTS

| | | | | |
|---|---|---|---|---|
| 7,487,838 | B2 | 2/2009 | Knight et al. | |
| 2003/0062161 | A1 * | 4/2003 | Mondelli et al. | 166/291 |
| 2003/0221836 | A1 | 12/2003 | Gardes | |
| 2005/0252689 | A1 | 11/2005 | Gardes | |

FOREIGN PATENT DOCUMENTS

| | | | |
|---|---|---|---|
| WO | 03102368 | A1 | 12/2003 |
| WO | WO 2006/108091 | | 10/2006 |

OTHER PUBLICATIONS

US CIP U.S. Appl. No. 12/291,664, filed Nov. 10, 2008.
US National Phase U.S. Appl. No. 11/910,895, filed Oct. 5, 2007.
U.S. Appl. No. 60/908,683, filed Mar. 29, 2007.
International Publication No. WO 2006/108091.
U.S. Appl. No. 11/399,793, filed Apr. 5, 2006.
U.S. Appl. No. 60/668,896, filed Apr. 5, 2005.

* cited by examiner

WELL BORE FLUID REDISTRIBUTION AND FLUID DISPOSAL IN WELLBORE ENVIRONMENTS

This application is a continuation of U.S. National Phase application Ser. No. 11/910,895, filed Oct. 28, 2009, now abandoned which was a continuation-in-part of International Patent Cooperation Treaty Application No. PCT/US2006/012789, filed Apr. 5, 2006, which claims the benefit of U.S. Provisional Patent Application No. 60/668,896, filed Apr. 5, 2005.

I. TECHNICAL FIELD

Generally, devices and methods of redistribution of fluids produced in well bore environments. Specifically, well bore fluid redistribution apparatuses which can isolate and redistribute fluids produced in well bores between geologic sections to reduce surface discharge of fluids.

II. BACKGROUND

Methane gas may be produced in the mining of coal. Coal formations naturally produce methane gas. For example, methane gas may be produced by dewatering activities of the mining process. Methane gas that is contained in the coal formation may be biogenic (generated by biologic organisms) or organic (generated by organic decomposition of coal) origin.

Recovery of the methane gas present in coal formations is a major source of methane gas for the modern coal bed methane (CBM) industry. The recovery of such methane gas from coal formations frequently involves the removal of water from the coal bed, so as, for example, to provide a reduction of pressure within the formation. The water may often be found within the coals and typically may be under pressure that increases with depth below the surface. Methane gas can be contained in the formation, for example in solution with the formation water (either free flowing or interstitially within the rock) or adsorbing to the surface of the rock. In mining operations, it may be necessary to remove the water prior to collecting the ore. The removal of water may liberate the methane from the water or the formation by reducing the pressure under which the water is found.

In well operations, it may be necessary to pump water from the coal aquifer when the well is completed for a coal bed methane well to produce gas. Although other factors, including formation characteristics, well drilling methods, and pumping rates may play a role in production, it may be that the removal of water is possibly the most important well production factor. Traditional techniques to remove water from the well bore may include the use of a submersible pump. The pump may be placed at a depth to maximize gas flow.

The process of obtaining the maximum gas flow is often referred to as well optimization and may involve many factors. Well optimization may occur when the intake of the pump is set at a depth in the well to allow the maximum gas to be produced. If the intake is set too high in the well, water from the formation may not be sufficiently produced. In some instances, the weight of the water with reference to static water level (SWL) may prohibit the gas from desorbing from the coal and water. If the intake is set too low, water from the formation may not be sufficiently produced and the water may no longer float the coal fractures (keeping them open), possibly negatively affecting gas desorption or possibly inhibiting the flow of gas out of the coal seam. The pumping rate of the water may be used to fine tune the static water level in the well bore and may be tied to many geologic factors. Water production rates may vary from 1 gallon per minute to several hundred gallons per minute, again depending possibly on geologic conditions such as coal permeability and the thickness of the coal itself Produced water of coal bed methane production may be discharged to the land's surface, possibly along ephemeral drainages, tributaries and reservoirs. The quality of the produced water may vary from better than some bottled waters to poor, possibly depending on proximity of the coal bed methane well to the coal aquifer recharge area. Water qualities of coal bed methane wells in some regions typically may be better than the shallow aquifer systems that may often be used by agricultural concerns for purposes such as stock watering. However, water quality problems may occur after the water reaches the surface and travels for any distance. Surface soils may often contain salts (cations and anions) which the water may possibly dissolve as it moves along through these surface soils. At some point in the drainage, these salts may begin to accumulate, thus possibly reducing the discharged water quality. This issue may heretofore have been the subject of many studies exploring how this process may occur and the amount of time and distance over which this effect may become apparent.

The discharged water may become impaired because the discharged water may acquire salts along its path to tributaries. This impaired water may ultimately commingle with unimpaired water and may eventually degrade the fresh water supply. In an effort to monitor the amount of impaired water entering the fresh water system, governmental agencies have developed regulatory rules such as requirements for coal bed methane producers, for example permit requirements. One such permit requirement involves acquiring a National Pollution Discharge Elimination System (NPDES) permit. However, the NPDES permit acquisition process may involve significant drawbacks for coal bed methane producers, including the possibility of a substantial time and financial investment for the producer in obtaining the permit and the possibility of a denial of the permit.

In addition, environmental interests have expressed the concern that coal bed methane industry practices waste limited fresh groundwater resources. It is typically suggested that water produced by coal bed methane processes should be re-injected back into the ground. However, traditional re-injection methods may not have been economically viable to re-inject a high volume of produced water from a large number of wells. The drilling costs of each well may detract from economic viability of traditional re-injection methods. Furthermore, some formations may already contain a substantial amount of water, thus requiring large pump pressures to exceed the fracture rate of these formations in order to inject the additional waters. Traditional re-injection methods, furthermore, may be cost prohibitive given surface equipment and processes required.

Attempts may have been made to re-inject produced water into a principal drinking water aquifer where aquifer capacity may be available from a number of supply wells. However, facility and treatment costs may be prohibitively expensive. Other traditional re-injection techniques involve drilling an additional well or wells near an existing coal bed methane well for re-injection into a shallow aquifer system, but again these attempts may not have been economically viable due to the added costs of the additional wells as well as equipment and pumping costs to reinject the water back into the formations. Yet other attempts have involved using the produced water for irrigation, but the expenses involved in irrigation (for example, the capital outlay for an irrigation system and the treatment of soils to prevent souring) may have been so high as to be economically unsustainable. Still attempts may have involved the use of large leach-fields to dispose of water, but it may have been that relatively low permeability soils such as tight clay soils hindered the percolation process.

Other water removal attempts have been made in the context of brine water produced from conventional oil and gas reservoirs. For example, U.S. Pat. No. 3,363,692 discloses the use of a conventional beam pump or possibly pressure from the formation itself to move brine water mechanically into a shallower brine formation. However, this technique may be dependent on certain pressure ranges to work properly and may perhaps require a time cycle controller to switch a valve when water reaches a set height or time. Another patent, U.S. Pat. No. 5,816,326, discloses the use of a conventional beam pump to move brine water mechanically into a brine formation. This technique, however, appears to require the use of two mandrels to isolate perforations adjacent to a porous formation and perforated tubing to allow brine water to exit the tubing string.

The technologies of the above referenced patents and other similar technologies may also be limited in application to brine water disposal for oil and gas reservoirs and not particularly addressing the complexities of redistribution of fresh water into a fresh water system or the corresponding environment. Furthermore, the complexities associated generally with oil and gas reservoirs and traditional production equipment may actually lead those in the field away from thoughts of more efficient and less mechanically complex techniques, and particularly given the differences in the production environment.

It may be that previous attempts have been made to avoid the possible need of obtaining an NPDES permit for discharging water to the ground surface. It may also be that use of re-injection, irrigation and percolation may allow for different permitting requirements less stringent than, for example, the NPDES permit. Accordingly, a need may exist to avoid the NPDES permit system altogether, thus possibly streamlining the permit procedure and potentially reducing costs.

Water may also have a role in the secondary and tertiary recovery of oil and gas. Secondary and tertiary recovery is the recovery of oil or gas, or combinations thereof, in production-depleted reservoirs exhibiting low pressure or low flow rates, such that production is not economical or too much gas or water is present. The formation pressure, volume of product, product displacement, or fluid flow may be reduced for various reasons. In some optimal oil fields, it may sometimes be estimated that approximately 30 percent of the oil may be removed by pumping the wells (primary recovery), thus leaving perhaps 70 percent of the oil as unrecoverable. Secondary recovery, including traditional lift systems and injection methods, is typically implemented to maintain pressure and sustain production at viable rates.

Tertiary recovery or enhanced recovery alters the original oil properties and further maintains formation pressure and may be able to increase production by perhaps about 15% percent. Tertiary recovery may comprise techniques such as chemical or water flooding, miscible displacement, and thermal recovery. Examples include forms such as water flood, nitrogen flood, fire flood and steam flood. Each such technique may be reservoir dependent, and often the choice of technique may be based upon economics and availability. For example, if there is no readily available source of $CO_2$ near the production facility (miscible displacement), it may be that a $CO_2$ flood may not be economically viable.

Water injection and water flooding may be common forms of secondary and tertiary recovery, perhaps due to the typical availability of large quantities of water during production. Water may be acquired perhaps by drilling a water supply well or possibly by using by-product water from existing operations. This water may typically need to be treated, perhaps by chlorination, to some standard prior to being re-injected. Injection wells may often be other existing wells, perhaps which may have diminishing production or possibly which may be optimally located for the flooding operation. However, sometimes new wells may be drilled in an area to serve solely as injection wells.

The principal in traditional water flooding may be to move the oil or other recoverable substance that may be contained within a reservoir formation to the pumping bore of a production well and to maintain formation pressure. To accomplish this technique, water may be pumped into the reservoir formation, perhaps so as to displace the trapped oil or other recoverable substance and possibly to move it towards a production well. The amount of pressure involved in driving the water within the reservoir formation may be highly variable. Such pressure may rely primarily on the transmissivity of the reservoir formation. Such pressure also may be influenced by the casing size of the well bore and the number and type of perforations made in the casing. Water flooding may typically require surface facilities such as one or more storage tanks (tank batteries), treatment facilities, pumping equipment and pipelines to be constructed. Such surface facilities may ultimately increase the operating cost of the field, perhaps reducing the economic viability of the operation.

The foregoing problems regarding conventional techniques represent a long-felt need for an effective solution. Actual attempts to meet the need to dispose or treat produced water may have been lacking in one or more aspects, for example as previously described. Those skilled in the art may not have fully appreciated the nature of the problems and challenges involved. As a result, attempts to meet these needs may not have effectively solved one or more of the problems or challenges here identified. These attempts may even have taught practices diverging from the technical directions taken in the present invention. The present invention could be considered an unexpected result of new approaches to conventional techniques that have been taken by some in the field.

III. SUMMARY OF THE INVENTION

The redistribution of fluids in well bore environments is disclosed herein in accordance with the present invention. In some embodiments, the invention is the redistribution of fluid within a well bore. The fluid may be water produced in a coal bed methane well. The redistribution of fluid, such as water, from one geologic section such as a formation to another is disclosed herein, and the redistribution from one aquifer to another aquifer is provided in accordance with the present invention. The redistribution of fluid from multiple geologic sections such as one or more formations to other geologic sections such as another formation is also disclosed. Furthermore, the injection of a geologic section with fluid, such as water produced in a coal bed methane well, and in some embodiments as a water flood of a geologic section such as a reservoir formation, in accordance with the present invention is disclosed. Some embodiments are directed to injecting fluid into at least one geologic section above a depth, while some embodiments are directed to injecting fluid into at least one geologic section below a depth. Some embodiments are directed to the redistribution of fluid from multiple producing geologic sections. Still further embodiments provide commingling of produced gases from multiple sections as a further embodiment of the present invention. Each of the embodiments of the present invention is disclosed both as methods and processes as well as one or more apparatus and assembly.

The present invention in some embodiments is disclosed as one or more well bore fluid redistribution assembly or well bore fluid redistribution apparatus. The invention in some embodiments is methods of complying with water discharge rules. Other embodiments are water disposal, aquifer recharge, transfer of water from one aquifer or multiple aquifers to another, and obtaining a permit. Still other embodiments of the present invention are the provision of re-dressable packer assembly. Other embodiments are directed to fully connectable ports providing for features of the present invention.

One object of the present invention may be to address and perhaps avoid discharging water produced by coal bed methane wells to the surface. Still another object of the invention may be to address compliance with water discharge rules. Another object of the invention may be to address and minimize regulatory costs associated with redistributing water produced by coal bed methane wells. Yet a further object of the invention may be to redistribute water from one geologic section to another or from multiple geologic sections to another, such as from one aquifer or a plurality of aquifers to another aquifer. An additional object of the invention may be to provide a water flood of a geologic section, such as a formation reservoir. Another object of the invention may be to provide for multiple completion sections of a well and to facilitate circulation of a fluid such as water to maintain well conditions as part of the present invention. Still other objects may be to provide for the exchange of seal elements and for the ports of the present invention to allow for the connection with other features of the present invention.

Naturally, further objects of the invention will become apparent from the description and drawings below.

IV. A BRIEF DESCRIPTION OF THE DRAWINGS

V. DETAILED DESCRIPTION OF THE PREFERRED EMBODIMENTS

Generally, devices and methods of redistribution of fluids produced in well bore environments. Specifically, well bore fluid redistribution apparatuses which can isolate and redistribute fluids produced in well bores between geologic sections to reduce surface discharge of certain portions of the fluids.

Figure 1:
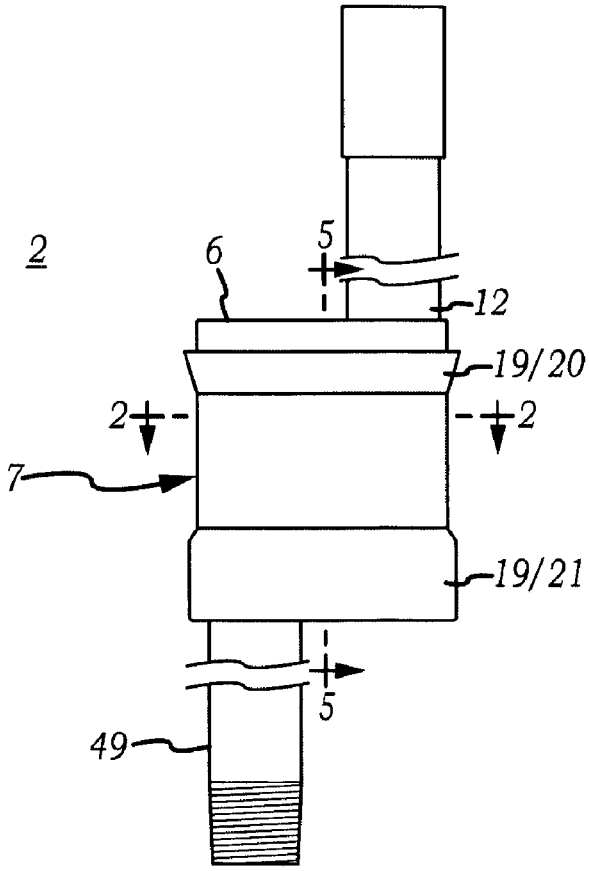
FIG. 1 is a front view of a particular embodiment of a well bore fluid redistribution apparatus.
Figure 2:
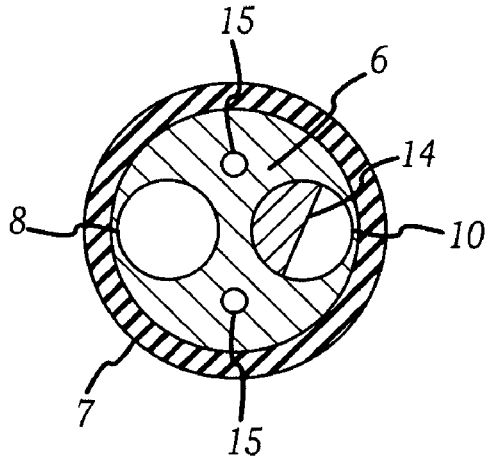
FIG. 2 is a cross-section view of the particular embodiment of the well bore fluid redistribution apparatus.
Figure 3:
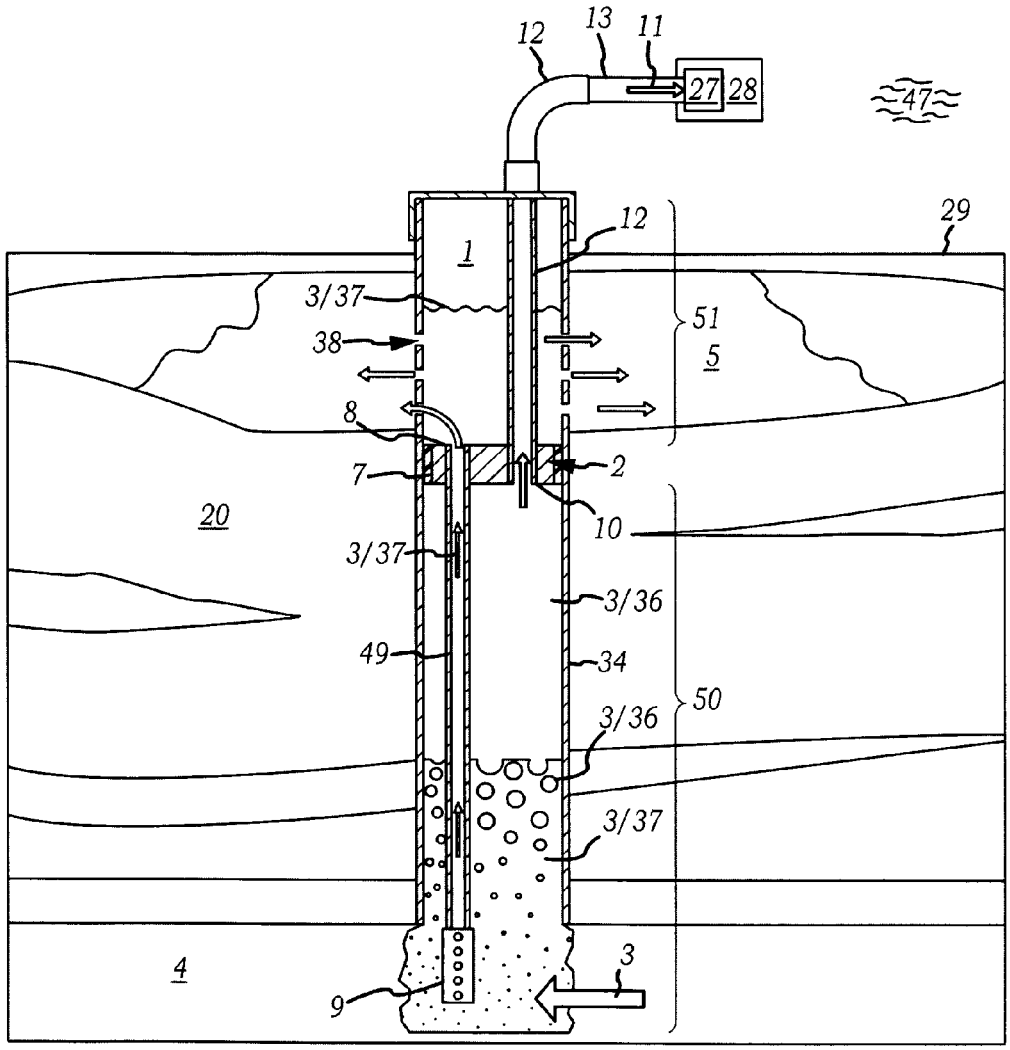
FIG. 3 is a cross-section view a particular embodiment of a well bore fluid redistribution apparatus having a location in a well bore.

Now referring primarily to FIGS. 1, 2 and 3, certain embodiments of a well bore fluid redistribution apparatus (2) (also referred to as the "apparatus") are shown which can be located in a well bore (1) (see example in FIG. 3). The external surface of the well bore fluid redistribution apparatus (2) can sufficiently circumferentially engage a corresponding part of the well bore (1) (or the well bore casing (34)) to isolate fluid (3) on either side of the apparatus (2). The fluid (3) isolated on either side of the apparatus (2) can be redistributed within the well bore (2) or redistributed between a first geologic section (4) and a second geologic section (5) (or more geologic sections depending upon the application) in communication with the well bore (1) by operation of the apparatus (2), as further described below.

Now referring primarily to FIGS. 1 and 2, certain embodiments of the well bore fluid redistribution apparatus (2) can provide a body (6) configured to coaxially slide in the well bore (1) having an external surface configured to engage a corresponding surface of the well bore (1) to isolate the fluid (3) in the well bore to either side, as above described. Other embodiments of the apparatus (2) can further include a well bore seal element (7) which can engage a part of the external surface of the body (6). The well bore seal element (7) can sealably engage a corresponding part of the surface of the well bore (1) (or a part of the surface of a well bore casing (34)) to isolate the fluid (3) on either side of the well bore redistribution apparatus (2). Certain embodiments of the well bore seal element (7) circumferentially engage the body (6) of the well bore redistribution apparatus (2) (see for example the embodiments shown in FIG. 1 and FIG. 2); however, the specific embodiments of the invention shown in FIGS. 1 and 2 are not intended to be limiting and certain embodiments of the invention can provide the body (6) without the well bore seal element (7) or with a well bore seal element (7) which is differently configured but yet capable of sealably engaging a corresponding part of the surface of the well bore (1) (or the well bore casing (34)).

Figure 4:
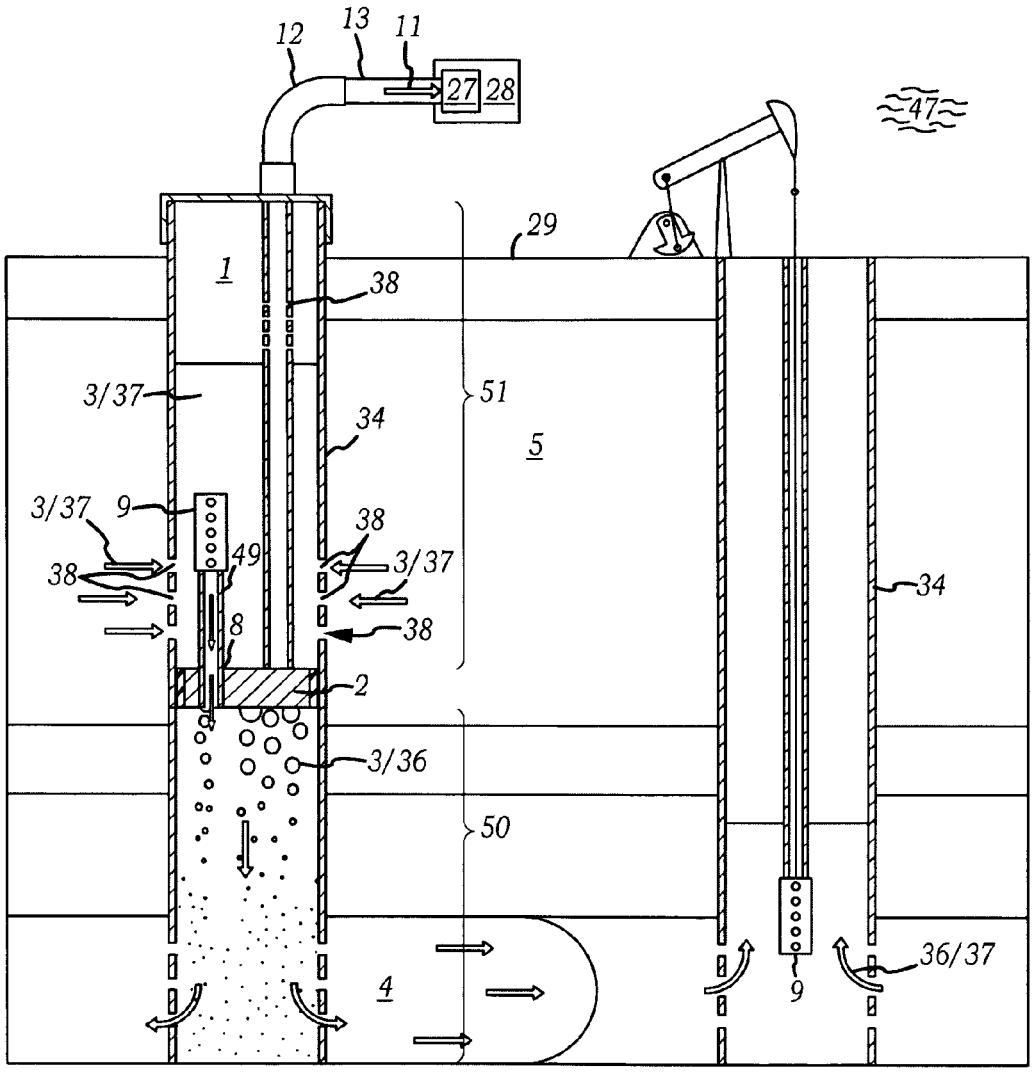
FIG. 4 is a cross-section view of another particular embodiment of a well bore fluid redistribution apparatus having a location in a well bore.

Now referring primarily to FIGS. 2, 3 and 4, a first port (8) (which can be one, two or a plurality of first ports depending upon the embodiment of the invention) can provide fluid communication through the body (6) of the apparatus (2). The first port (8) can be coupled to a pump (9) by a pump conduit (49). The pump conduit (49) can couple to each of the first port (8) and the pump (9) with mated threads, welded joints, compression fittings, or other matable coupling elements. Specifically referring to FIG. 3, as to certain embodiments of the invention, the pump (9) can be located in an amount of the fluid (3) in the form of a liquid (37) isolated below the apparatus (2) (also referred to as the first portion (50) of the well bore (1)). The pump (9) may be a submersible or progressive cavity pump or other manner of device which can generate a flow (shown by arrows in the Figures) of the fluid (3) in the form of a liquid (37). Operation of the pump (9) can transfer of an amount fluid (3) in the form of a liquid (37) isolated below the apparatus (2) from a first geologic section (4) (the term "first geologic section" broadly defines one or more geologic sections) to a second geologic section (5) (the term "second geologic section" broadly defines one or more geologic sections) above the apparatus (2). Now referring specifically to FIG. 4, as certain other embodiments of the apparatus (2), the pump (9) can be located in an amount of fluid (3) (shown as an amount of liquid (37) isolated above the apparatus (2) in the well bore (1) (also referred to as the second portion (51) of the well bore (1)). Operation of the pump (9) can transfer the amount fluid (3) isolated above the apparatus (2) in the well bore (1) from the second geologic section (5) (the term "second geologic section" broadly defines one or more geologic sections) to the first geologic section (4) (the term "first geologic section" broadly defines one or more geologic sections) below the apparatus (2).

Again referring primarily to FIGS. 2, 3 and 4, the apparatus (2) can include a second port (10) (which can be one, two, or a plurality of second ports depending upon the embodiment of the invention). A particular embodiment of the second port (10) provides fluid communication through the body (6) of the apparatus (2) to facilitate transfer of an amount of bypass fluid (11) isolated below the apparatus (2) through the body (6) of the apparatus (2) and through a bypass conduit (12) to a well outlet (13). The bypass fluid (11) can be a gas (36) (such as a mixture of gases, coal bed gases, methane gas, air, or the like, whether alone or in various permutations and combinations). Certain embodiments of the second port (10) can further include a flow control element (14) to control flow of the bypass fluid (11) through second port (10). The flow control element (14) can be one or more valves coupled to the second port (10). Such valves may include check valves, ball or globe valves, gate valves, or similar flow control elements.

Now referring primarily to FIG. 2, the well bore fluid redistribution apparatus (2), can further provide one or more utility ports (15). The utility ports (15) each provide a passage through the body (6) of the apparatus (2) through which power cables, sensors, transducers, or the like, can pass from above the apparatus (2) to below the apparatus (2) in the well bore (1). While the embodiment of the invention shown in FIG. 2 provides two utility ports (14), the invention is not so limited and any number of utility ports can be provided depending on the application one, two, or a plurality.

Figure 5:
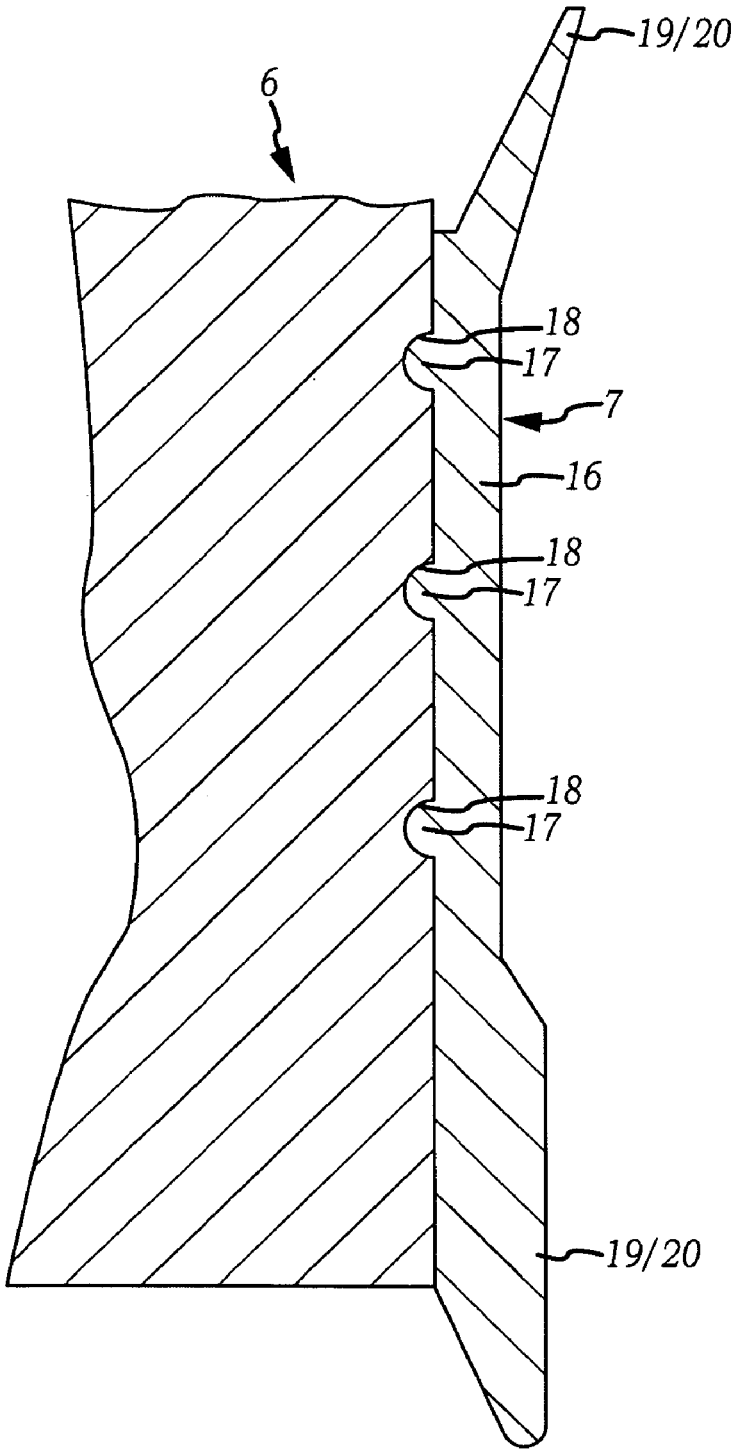
FIG. 5 is cross-section view of a particular embodiment of a well bore seal element.

Now referring primarily to FIG. 5, a particular embodiment of the well bore seal element (7) is shown which has the general structure and relative dimensions shown in the cross-section view. The embodiment of the well bore seal (7) provides a sleeve (16) which circumferentially couples or couples about the body (6) of the apparatus (2) in similar fashion to the embodiment of the well bore seal element (7) shown in FIG. 1. One or more fastening elements (17) can be coupled to the sleeve (16). The fastening elements (17) can be configured to engage the body (6) of the apparatus (2). For example, the embodiment of the fastening elements (17) shown in FIG. 5 engage correspondingly configured circumferential grooves (18) of the body (6) to hold the well bore seal (7) in fixed relation to the body (6) of the apparatus (2) during normal use. While the embodiment of the fastening elements (17) shown in FIG. 5 provides three rings of semicircular configuration each of which can fit a correspondingly configured circumferential semicircular groove (18) of the body (6) of the apparatus (2), the invention is not so limited, and the fastening elements (17) can be of any configuration which sufficiently fixes the sleeve (16) in relation to the body (6) of the apparatus (2) to allow normal use and sealable engagement of the apparatus (2) with a corresponding part of the well bore (1). For example, the fastening elements (17) can be a greater of lesser number of rings or other projection elements, of greater or lesser relative dimension, of similar or different geometric configuration (such as triangular, rectangular or square, or the like) or can be mechanical fasteners such screws or bolts having a spirally threaded shaft which interpenetrates the sleeve (16) to rotatingly couple in correspondingly spirally threaded bore of the body (6) of the apparatus (2).

The well bore seal (7) can further include one or more seal elements (19) coupled to the sleeve (16) each of which can project a sufficient distance outwardly from the body (6) of the apparatus (2) to allow sealable engagement with the corresponding part of the well bore (1). As to certain embodiments of the invention, the seal elements (19) can take the constructional form in cross-section of a substantially triangular element (20) as shown in FIG. 5, or can be a raised portion (21) of the sleeve (16) (that portion of the sleeve (16) having a greater thickness) as shown in FIG. 5; however, the particular configuration of the seal elements (19) shown in FIG. 5 is not intended to be limiting with respect to the numerous and wide variety of seal element (19) configurations which can allow sealable engagement with the corresponding part of a well bore (1).

Figure 6:
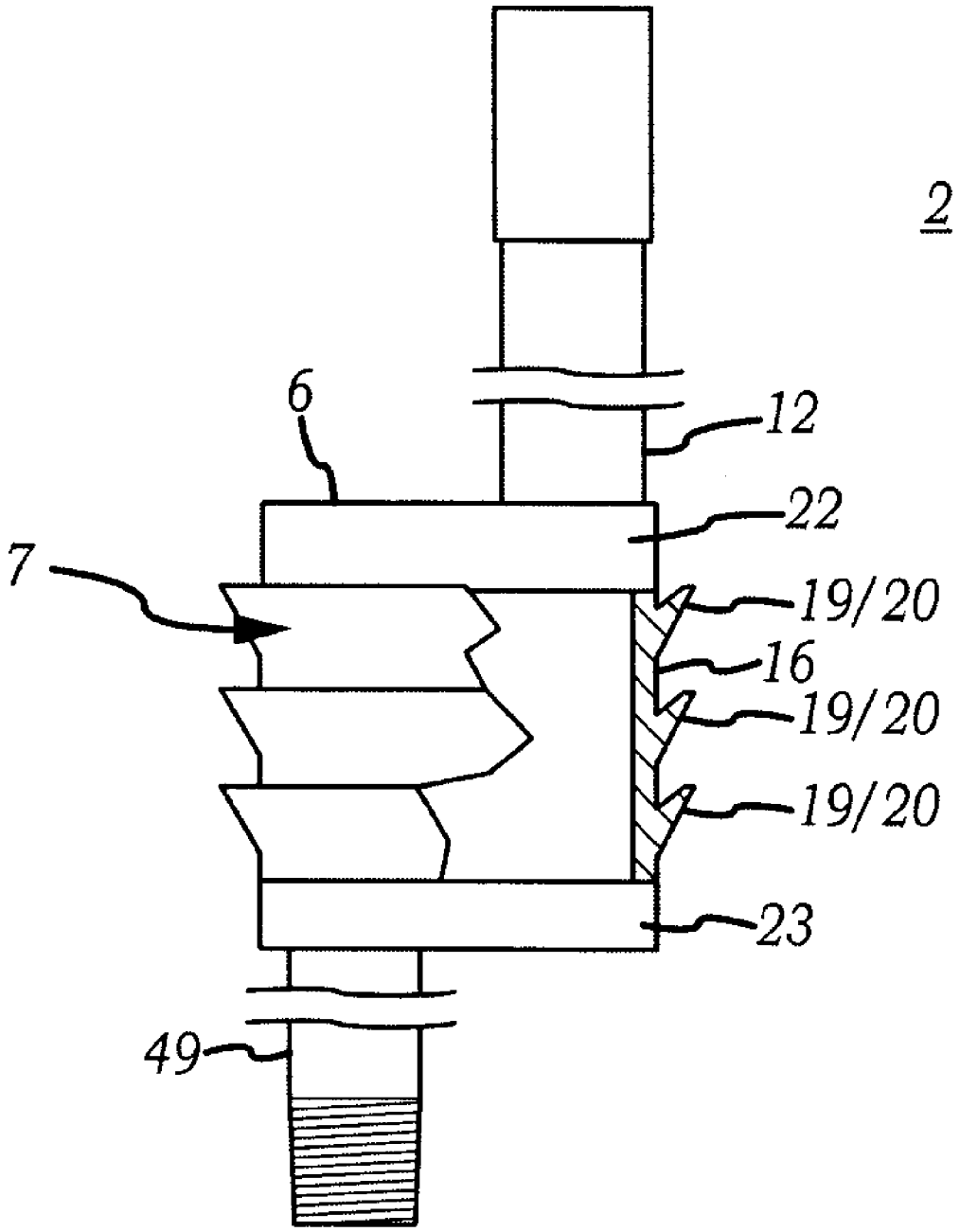
FIG. 6 is a front view of an embodiment of a well bore fluid redistribution apparatus with a particular embodiment of a well bore seal element shown in cross-section.

Now referring primarily to FIG. 6, a further embodiment of a well bore seal element (7) provides a sleeve (16) configured to circumferentially engage the body (6) of the apparatus (2) between a pair of raised bands (22) (23). The pair of raised bands (22) (23) and the body (6) can be produced as a single piece and the sleeve (16) can be produced of sufficiently resiliently flexible material to allow the sleeve (16) in a stretched condition to be drawn over the first of the pair of raised bands (22) and located between the pair of raised bands (22) (23) in the unstretched or retracted condition. Alternately, the pair of raised bands (22) (23) and the body (6) can be produced as a plurality of pieces with the sleeve (16) fitted about the body and the pair of raised bands (22) (23) subsequently coupled to the body (6) of the apparatus (2). Location of the sleeve (16) between the pair of raised bands (22) (23) can provide another embodiment of a fastening element (17) to the examples shown in FIG. 5 and above described or an alternative to providing any other fastening element (17). The raised bands (22) (23) shown in FIG. 6 are not intended to have any particular dimensional relationship to the body (6) or the sleeve (16) other than to provide a recessed part in which the sleeve (16) can be located with the seal elements (19) projecting sufficiently beyond the raised bands (22) (23) to engage a corresponding part of the well bore (1).

In the particular embodiment of the invention shown in FIG. 6, a plurality of seal elements (19) can be circumferentially disposed about the sleeve (16) to project outwardly a sufficient distance to sealably engage with a part of the surface of the well bore (1) (or the well bore casing (34)). While three seal elements (19) are shown in FIG. 6, the invention is not so limited, and embodiments of the well bore seal element (7) can provide one, a pair, three, or a plurality of seal elements (19) whether providing a substantially triangular element (20) a raised portion (21) or other seal element configuration, or combinations or permutations thereof. The constructional forms of the sleeve (16) shown in FIG. 7 or similar constructional forms can be produced by various production methods such as fabrication, molding, or the like. One embodiment of the well bore seal element (7) can be molded using a variety of polyurethane, or other polymer compositions, which provide sufficient flexibility, compression, resiliency, and hardness for use as above-described.

Again referring primarily to FIG. 6, removal of the well bore seal element (7) can be accomplished in reverse order to redress or replace the well bore seal element (7). Redressing of the well bore seal element (7) to provide various thicknesses of the well bore seal element (7) can address various different inner diameter (ID) dimensions of the well bore (1) (or well bore casing (34)). The constructional form of the well bore seal element (7) depicted in FIG. 6 provides an embodiment having a plurality of seal elements (19) which project outwardly at an angular relation to the sleeve (16) such that upon location in a well bore (1) an upward movement of the body (6) of the apparatus (2) in the well bore (1) increases frictional resistance of the engaged surfaces of the well bore seal element (7) and the well bore (1) to be remove the well bore sleeve element (7) from body (6) of the apparatus (2). A new well bore seal element (7) may then be installed onto body (6).

Figure 7:
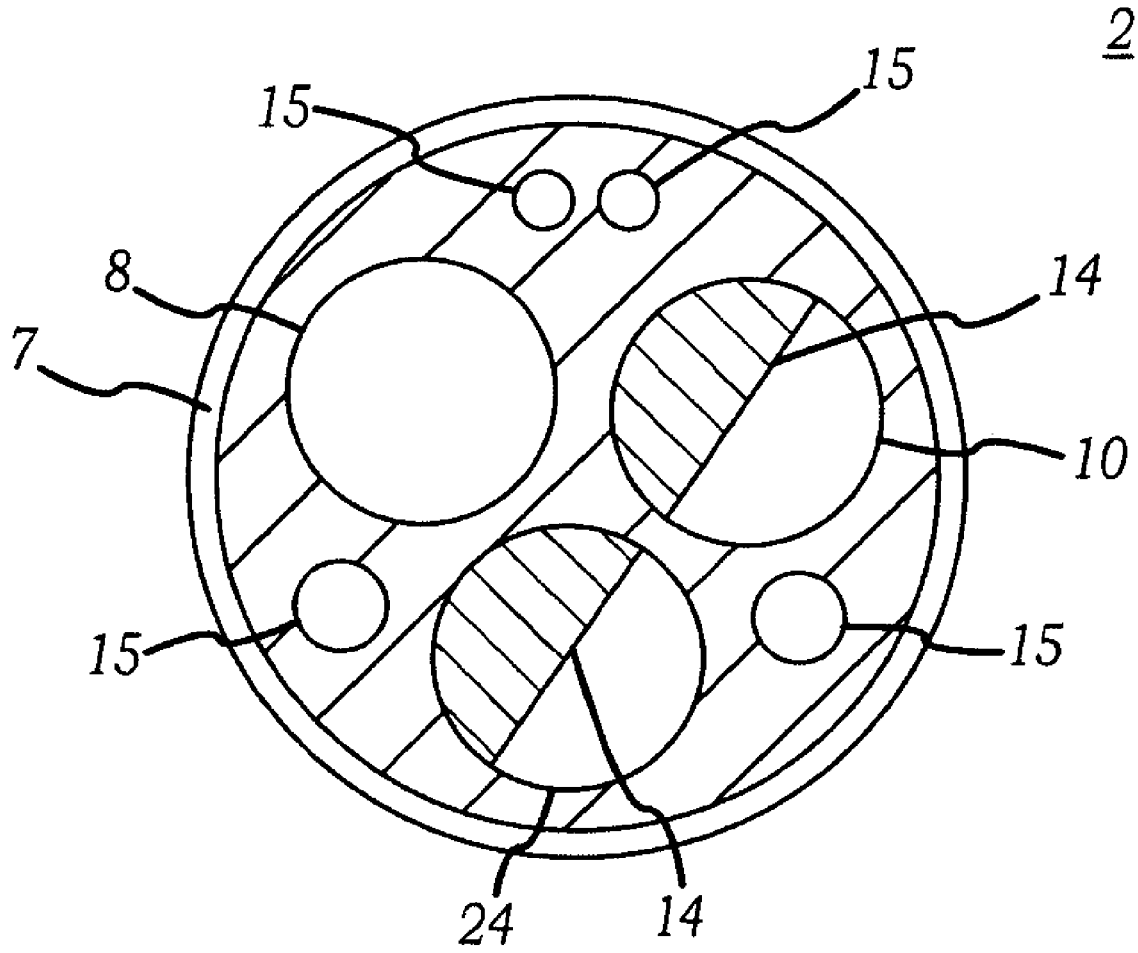
FIG. 7 is a cross-section view of the particular embodiment of the well bore fluid redistribution apparatus.
Figure 8:
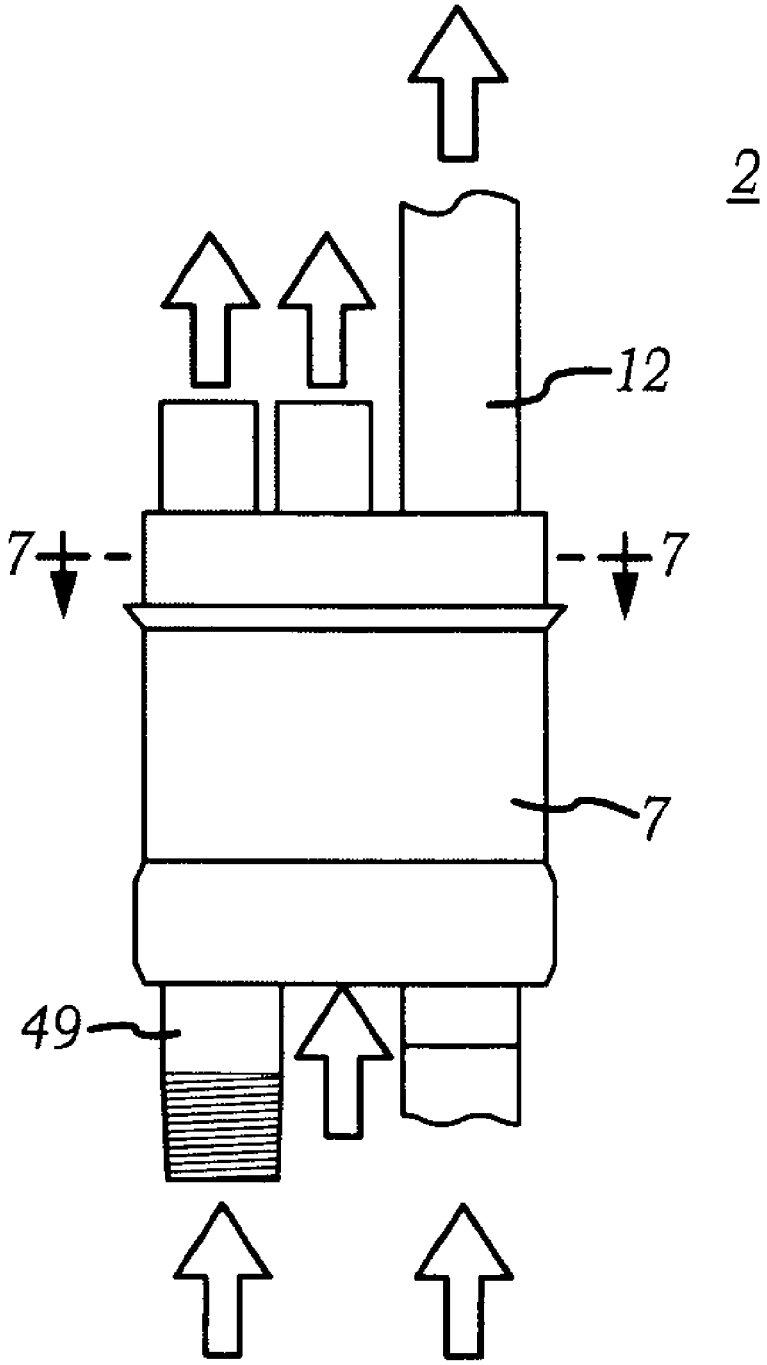
FIG. 8 is a front view of an embodiment of a well bore fluid redistribution apparatus.

Now referring primarily to FIGS. 7 and 8, certain embodiments of the well bore fluid redistribution apparatus (2) can further include a third port (24) (which can be one, two or a plurality of third ports depending upon the embodiment of the invention) which allows use of two or more of the well bore fluid redistribution apparatus (2) in a well bore (2). The third port (24) in certain embodiments can be coupled to a pump (9) to transfer bypass fluid (11) to a well outlet (13). One or more flow control elements (14), as above described, may be used to control fluid communication through the third port (24).

Now referring primarily to FIGS. 1, 2, 7, 8, 9, and 10, certain embodiments of the well bore fluid redistribution apparatus (2) can further provide a second apparatus (25) having a first port (8), a second port (10) and a third port (24) as shown in FIG. 7 and 8 which can be coupled to the first apparatus (26) having a first port (8) and a second port (10) as shown in FIGS. 1 and 2. Now referring specifically to FIG. 9, the second apparatus (25) and the first apparatus (26) can be coupled in fixed relation such that the first apparatus (26) and the second apparatus (25) can be coaxially slide in the well bore (1) to locate each of the first apparatus (26) and the second apparatus (25) at a location in the well bore (1) which allows isolation of an amount of fluid (3) above and below each of the first apparatus (26) and the second apparatus (25).

The first port (8) of the first apparatus (26) can provide fluid communication through the body (6) of the first apparatus (26). A pump (9) can be provided in fluid communication with the first port (8) of the first apparatus (26) if the hydrostatic pressure of the fluid is insufficient to transfer the fluid through the first port (8). In the embodiment shown in FIG. 9, the pump (9) engages an amount of fluid (3) (the fluid for example being a liquid such as water) isolated below the first apparatus (26) (in a first portion (50) of the well bore (1)) produced by a first geologic section (4). Operation of pump (9) (or hydrostatic pressure of the liquid) in fluid communication with the first port (8) of the first apparatus (26) redistributes the fluid (3) in the first portion (50) of the well bore (1) below the first apparatus (26) to a second portion (51) of the well bore (2) above the second apparatus (26) or to a second geologic section (5) in fluid communication with the second portion (51) of the well bore (I) located above the first apparatus (26).

The second port (10) of the first apparatus (26) can also provide fluid communication through the body (6) of the first apparatus (26). A reduced pressure can be applied to the second port (10) of the first apparatus (25) to transfer an amount of fluid (3) (the fluid for example being a gas (36)) isolated in the first portion (50) of the well bore (1) below the first apparatus (26) produced by the first geologic section (4) to the second portion (51) of the well bore (1) above the second apparatus (26).

In the example provided by FIG. 9, the first geologic section (4) may be a first coal zone (or a plurality of coal zones) in fluid communication with the first portion (50) of the well bore (1) below the first apparatus (26) and the second geologic section (5) can be second coal zone (or a plurality of coal zones) in fluid communication with the second portion (51) of the well bore (1) above the first apparatus (26). The first geologic section (4) (the first coal zone) located below the depth of first apparatus (26) can produce water and a mixture of gases (36) (such as coal zone gases). Operation of the pump (9) in fluid communication with the first apparatus (26) can redistribute the water in the first portion (50) of the well bore (1) below the first apparatus (26) to a second portion (51) of the well bore (1) above the first apparatus (26). In some embodiments, the pump (9) can provide active production of the fluid (3) from the first geologic section (4) (the first coal zone) in fluid communication with the first portion (50) of the well bore (1 (below the first apparatus (26), not relying upon hydrostatic pressure alone. This manner of generating active production of a fluid (3) from a first geologic section (4) or the active transfer of the fluid (3) to a portion of the well bore (1) above the second apparatus (26) (or to a second geologic section (5)) may be considered a controlled step or feature in regard to certain embodiments of the invention.

The bypass conduit (12) can be coupled to the second port (10) of the first apparatus (26). Operation of a vacuum pump (27) which can be part of a compressor (28) (such as a gas compressor for the recovery of methane gas or mixtures of gases from well bores) can sufficiently reduce pressure in the bypass conduit (12) to transfer the coal zone gases isolated in the well bore (1) below the second apparatus (26) through the second port (10) to the bypass conduit (12) for transfer to the surface (29) or the compressor (28) or both.

Figure 9:
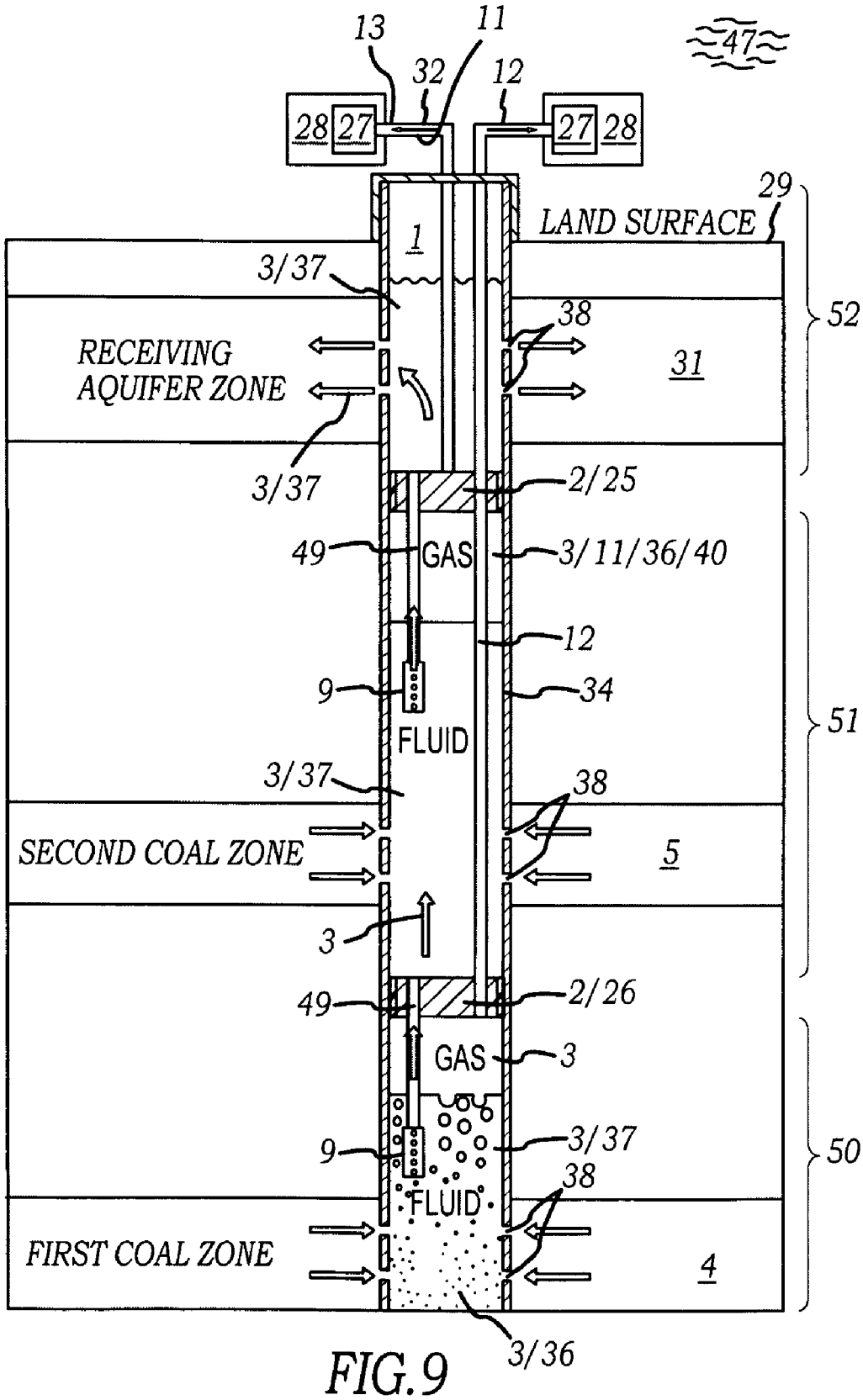
FIG. 9 is a cross-section view a particular embodiment of the invention which locates a first well bore fluid redistribution apparatus at a determined depth in a well bore and locates a second well bore fluid redistribution apparatus at determined depth in the well bore.
Figure 10:
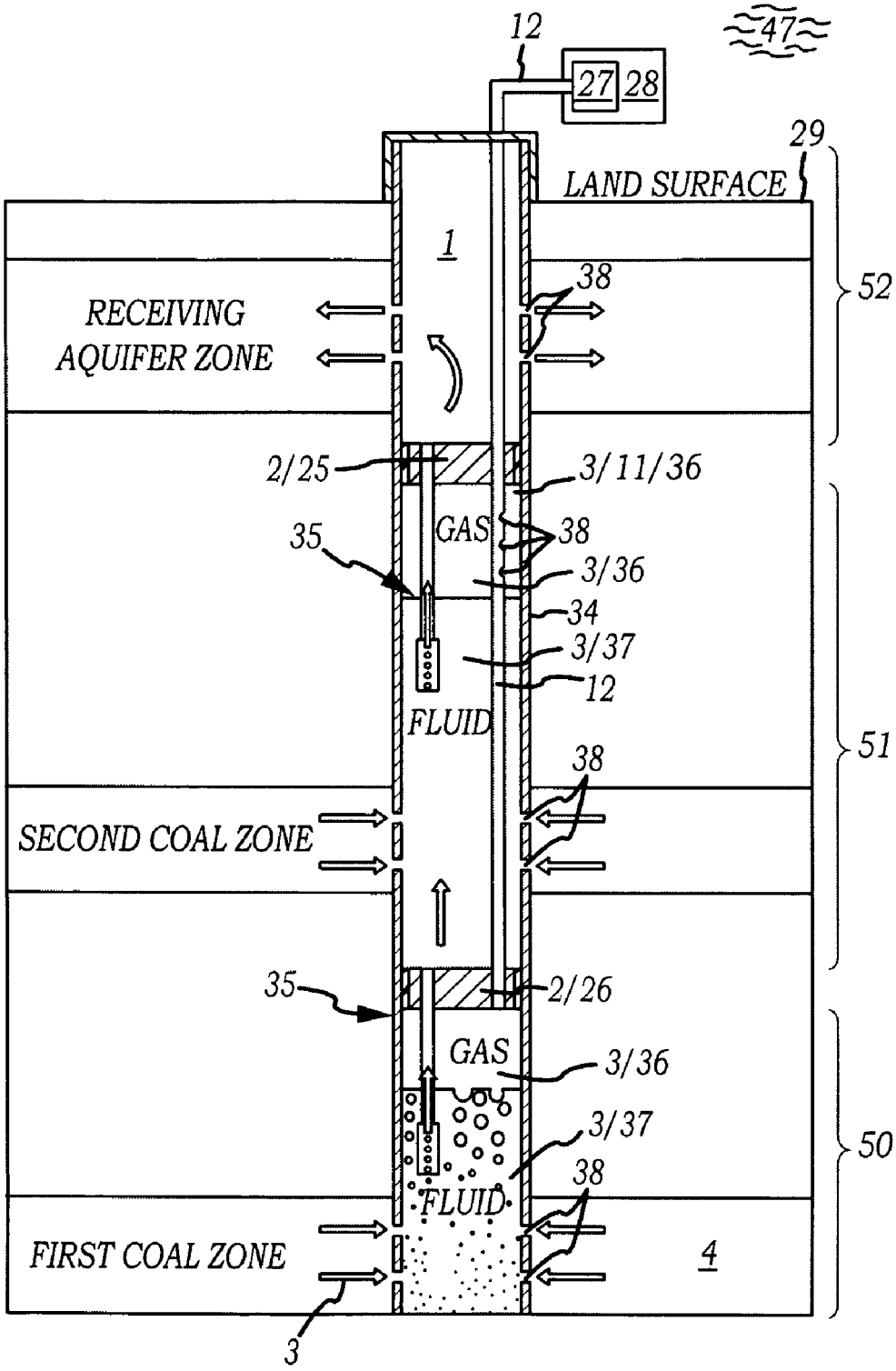
FIG. 10 is a cross-section view another particular embodiment of the invention which locates a first well bore fluid redistribution apparatus at a determined depth in a well bore and locates a second well bore fluid redistribution apparatus at determined depth in the well bore.

Again referring primarily to FIGS. 1, 2, 7, 8, 9, 10 a particular embodiment of the invention can further include a second apparatus (25) located a distance above the first apparatus (26) in the well bore (2). The second apparatus (25) can have a location which isolates the second geologic section (5) (shown as a second coal zone) in fluid communication with the second portion (50) of the well bore (1) below the second apparatus (25) and above the first apparatus (26) from a third geologic section (31) (shown in FIG. 9 as an aquifer zone) in fluid communication with a third portion (52) of the well bore (1) above the second apparatus (25). As to embodiments of the invention illustrated by the example of FIG. 9, the second apparatus (25) can be configured as shown in FIGS. 7 and 8, to provide a third port (24). As to embodiments of the invention as illustrated by the example of FIG. 10, the second apparatus (25/30) can be configured as shown in FIGS. 1 and 2.

With respect to the example of FIG. 9, the second apparatus (25) can be maintained in fixed relation to the first apparatus (26) by connection of a part of the bypass conduit (12) between the second port (10) of the first apparatus (26) and the second port (10) of the second apparatus (25), although other manners of maintaining the first apparatus (26) and the second apparatus (25) in fixed relation can be achieved by a connecting a member between the body (6) of the first apparatus (26) and the body (6) of the second apparatus (25) unconnected to any port(s). The part of the bypass conduit (12) connected between the second ports (12) of the first apparatus (26) and the second apparatus (25) can connected by mated spiral threads of the bypass conduit (12) and the second ports (10) (see for example FIG. 8) or other manner of connection such as welding, compression fit, ball and socket, or the like, which achieve sufficient engagement to maintain the first apparatus (26) in fixed relation to the second apparatus (25). The other part of the bypass conduit (12) can be connected to the outlet side of the second port (12) of the second apparatus (25) to transfer the fluid (3) in the form of coal zone gases isolated in the first portion (50) below the first apparatus (26) to the surface (29) or to a vacuum pump (27) which can be a part of a compressor (28).

Again referring primarily to FIG. 9, the fluid (3) produced by the second geologic section (5) (the second coal zone) in fluid communication with the second portion (51) of the well bore (1) above the first apparatus (26) and below the second apparatus (25) can be water, a mixture of gases, or both. A third port (24) of the second apparatus (25) which communicates through the body (6) of the second apparatus (25) allows transfer of fluid (3) in the form of the mixture of gases (36) isolated below the second apparatus (25) to the third portion (52) of the well bore (2) above the second apparatus (250. A second bypass conduit (32) can be coupled to the third port (24) (by mated spiral threads or otherwise). A second bypass conduit (32) can conduct the fluid (3) in the form of a gas (33) or mixture of gases isolated in the second portion (52) of well bore (2) below the second apparatus (25) and above the first apparatus (26) to the surface (29) or to a vacuum pump (27) which may be part of a compressor (28) (or a plurality of vacuum pumps or compressors).

The first port (8) of the second apparatus (25) can be fluidicly coupled to a pump (9) which engages the fluid (3) (in the form of a liquid or water) produced by the second geologic section (5) in fluid communication with the second portion (51) of the well bore (1) or transferred by the first apparatus (26) to the second portion (51) of the well bore (1), as above-described. Operation of the pump (9) can transfer the fluid (3) (in the form of water or other liquid) isolated in the second portion (51) of the well bore (1) below the second apparatus (25) through the first port (8) of the second apparatus (25) to the third portion (52) of the well bore (1) above the second apparatus (25) which can be redistributed to a third geologic section (31) whether actively by pumping or by hydrostatic pressure.

Now referring to the example of FIG. 10, the first apparatus (26) can be configured with a first port (8) and a second port (10) as shown in FIGS. 1 and 2. A plurality of bypass conduit apertures (33) can be located in the part of the bypass conduit (12) below the second apparatus (25) to allow transfer of the fluid (3) in the form of a mixture of gases (36) from the portion of the well bore (1) below the second apparatus (25) and above the first apparatus (26) through the second port (10) of the second apparatus (25) and through the bypass conduit (12) to the surface (29) or to the vacuum pump (27) which can be part of the compressor (28).

The first apparatus (26) and the second apparatus (25) of examples of FIGS. 9 and 10 can further include utility port(s) (15) to provide a passage through the body (6) of the second apparatus (25) for passage of power cables, sensors, transducers, or the like, to power the pumps, sense fluid levels, control operation of pumps, or the like.

Embodiments of the invention having configurations as shown by FIG. 10 can avoid the use of the third port (24) in the first apparatus (25). The examples of FIGS. 3, 4, 9 and 10 which show particular embodiments of the invention are not intended to be limiting. Rather these embodiments are intended to be illustrative of the broad range of embodiments of the invention which can be practiced by combination of the various elements described in various permutations by one of ordinary skill in the art.

As to certain embodiments, the well bore fluid redistribution apparatus (2) (25) (26) (or other embodiments of the well bore redistribution apparatus) may be engaged to a well bore casement (34) lining the well bore (1) at a gas separation depth (35), such as shown in any one of the examples of FIG. 3, 4, 9 or 10. The gas separation depth (35) may be the depth that allows for gas separation in the well bore (1) at the static water level. For example, the gas separation depth (35) may be a depth no greater than about 150 feet. A plurality of well casement apertures (38) can be made in the well bore casement (34) at the depth of the first geologic section (4), the second geologic section (5), or the third geologic section (31) as shown for example in FIGS. 3, 4, 9, and 10. The geologic sections (4) (5) (31) or other geologic sections may have been identified through sample collection during drilling of the well bore (1) or interpreted from available well or borehole logs. Fluid (3) in the form of a liquid (37) (such as water or oil) or gas (36) (such as coal bed gases) produced by a first geologic section (4) may flow through the plurality of apertures (38) in the well bore casement (34) by gravity or due to pressure created by the action of the pump (9). The fluid (3) redistributed from the first geologic section (4) can pass through a similar plurality of apertures (38) in the well bore casement (34) to the second geologic section (5) or a third geologic section (31) depending upon the embodiment of the invention. Gas (36) liberated from the liquid (37) may then flow through the second port (10) of the apparatus (2).

Deeper geological sections (4) (5) (31) may contain fluid (3) (such as water, oil, gas) under pressure and therefore may not readily accept redistributed fluid (3) unless forced under great pressure. The well bore fluid redistribution apparatus (2) can be configured to redistribute the fluid to a geologic section which can readily accept redistributed fluid (3) in accordance with any of the various embodiments of the invention such as a shallow unconfined aquifer may have available storage capacity due in part to agricultural and other development uses that may remove water. Shallow geologic sections having permeability or porosity that may accept water can be identified from wells that have been drilled, possibly with well or borehole logs, sample cuttings or core. In some embodiments of the invention, the plurality of apertures (38) may be made adjacent to such geologic sections and not to other geologic sections which cannot receive redistributed fluid (3).

Now referring primarily to FIGS. 3, 4, 9 and 10, the pump (9) can operate to drive liquid (37) from a first geologic section (4) to a space in the well bore (2) above the apparatus (2) and below the well head (39). The liquid (37) may be forced through the plurality of apertures (38) of the well bore casement (34) into the second geologic section (5). Gas (36) produced by the first geologic section (4) can be bypassed through what may be a water-filled space between the apparatus and the well head (39) through the bypass conduit (12). An estimate of the amount of liquid (37) to be pumped may be used for example to calculate the sizes, numbers, and interval spacing of the plurality of apertures (38) necessary or desired to redistribute the fluid (3) in accordance with any particular embodiment of the invention.

Certain particular embodiments of the invention may be utilized in a well bore (1) drilled for purpose of producing an amount of coal bed gas (the composition of coal bed gas can vary with the supply but primarily consists of methane and ethane) from a coal bed geologic section. The coal bed geologic section may produce an amount of coal bed water and an amount of coal bed gas (a part of the coal bed gas may be contained in the amount of water). Coal bed gas produced by the coal bed geologic section may be diverted by the apparatus through the bypass conduit to the surface to a compressor or a gas separator while the amount of coal bed water can be redistributed from the coal bed geologic section to an aquifer geologic section or another coal bed geologic section, in accordance with any of the embodiments of the invention.

Naturally, certain embodiments of the invention can be utilized only to redistribute a liquid (37) such as water from a first geologic section (4) to a second geologic section (5) without the coincident redistribution of a gas (36) from the first geologic section (4) to the second geologic section (5).

Similarly, certain embodiments of the invention can be utilized only to redistribute a gas (36) such as coal bed gas (40) from a first geologic section (4) to a second geologic section (5) without the coincident redistribution of an amount liquid (37) from the first geologic section (4) to the second geologic section (5).

Figure 11:
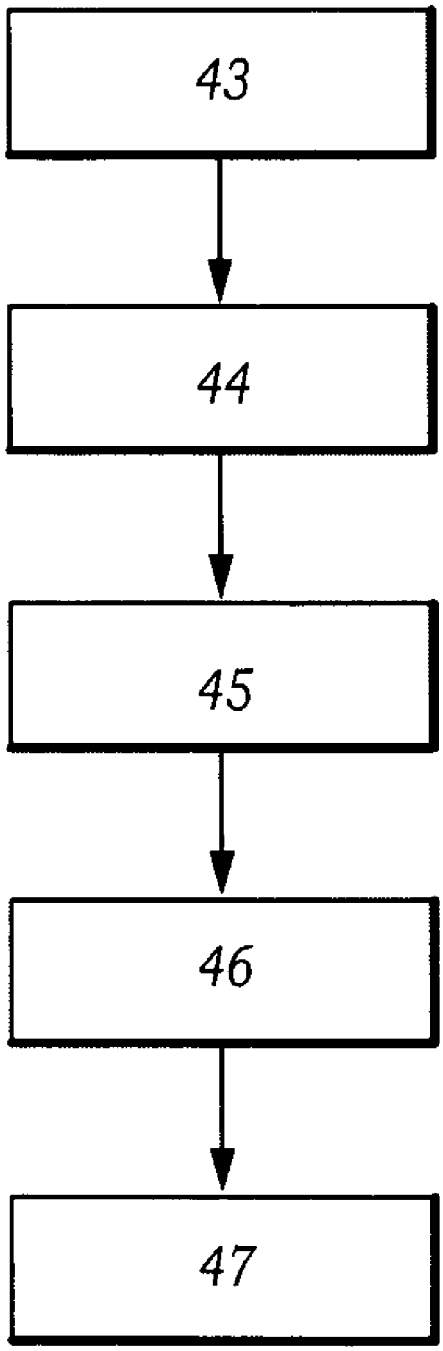
FIG. 11 is a block diagram which shows a particular method of the invention for distributing an amount of fluid between a first geologic section and a second geologic section.

Now referring primarily to FIG. 11, certain embodiments of the invention can include steps including: determining the depth of a first geologic section (4) (shown as block (43), determining depth of a second geologic section (5) (shown as block (44)), isolating the first geologic section from the second geologic section (shown as block 45), distributing an amount of fluid from the first geologic section (4) to the second geologic section (5) (shown as block 46).

In determining the depth of a first geologic section (43) or in determining depth of a second geologic section (44), any of a numerous and wide variety of assessment methods may be utilized separately or in various combinations or permutations such as sample collection during drilling of the well bore (1) or interpreted from available well or borehole logs other than the well bore (1), or geologic section maps, remote sensing images, geochemical surveys, or the like.

In isolating the first geologic section from the second geologic section (shown as block 45), any embodiment of the well bore fluid redistribution apparatus (2) or other similar or equivalent apparatus can be located at a depth in the well bore (1) between the first geologic section (4) and the second geologic section (5) with sufficient engagement of the external surface of the well bore fluid redistribution apparatus (2) (or similar or equivalent apparatus) to isolate the fluid (3) produced by either the first geologic section (4) or the second geologic section (5) (or both) above or below (or both) the well bore fluid redistribution apparatus (2).

In distributing an amount of fluid from the first geologic section (4) to the second geologic section (5) (46), the apparatus (2) can operate to transfer the isolated fluid (3) (whether a liquid or a gas) produced by the first geologic section (4) to the second geologic section (5). The first geologic section (4) can be located above or below the apparatus (2) and similarly the second geologic section (5) can be located above or below the apparatus (2) but as to those embodiments of the invention which include the step of isolating the first geologic section from the second geologic section (shown as block 45) the first geologic section (4) and the second geologic section (5) are typically located on opposite sides of the apparatus (2) (or similar or equivalent device).

Certain embodiments of the invention can further include the step of discharging fluid (3) to the surface (29) (shown as block 47). In discharging fluid to the surface (47) the fluid (3) can be a liquid (37) or a gas (36) whether isolated above or below the apparatus (2). As to those embodiments of the invention which include the step of distributing an amount of fluid from the first geologic section (4) to the second geologic section (5) (shown as block 46), typically, but not as to every embodiment, the liquid (37) can be redistributed from a first geologic section (4) to a second geologic section (5) while the gas (36) will be discharged to the surface (29). The term "discharging" includes discharge of the gas (or liquid) to the surface (29) or the atmosphere (48) or to a vacuum pump (27) or a compressor (28) or other facility for receiving and an amount of gas (36) or an amount of liquid (37).

As can be easily understood from the foregoing, the basic concepts of the present invention may be embodied in a variety of ways. The invention involves numerous and varied embodiments of a well bore fluid redistribution system including well bore fluid redistribution apparatus and methods of redistributing an amount of fluid in a well bore.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "seal" should be understood to encompass disclosure of the act of "sealing"—whether explicitly discussed or not—and, conversely, were there effectively disclosure of the act of "sealing", such a disclosure should be understood to encompass disclosure of a "seal" and even a "means for sealing." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the well bore fluid redistribution apparatuses herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A well bore fluid redistribution assembly, comprising:

a) a well bore fluid redistribution apparatus having a body adapted to engage a part of a well bore to fluidicly isolate a first portion of said well bore below said body and fluidicly isolate a second portion of said well bore above said body, and wherein said body provides isolation of an amount of fluid within said second portion of said well bore;

b) a first port in said body which provides fluid communication through said body;

c) a pump located in said first portion of said well bore in fluid communication with said first port, the assembly having one said body configured to provide injection of an amount of liquid into at least one geologic section in fluid communication with said second portion of said well bore;

d) a second port in said body, said second port adapted to permit an amount of gas rising in said first portion of said well bore to pass through said body; and e) a bypass conduit located in said second portion of said well bore coupled to said second port, said bypass conduit extending to the surface of the well bore to permit said amount of gas passing through said body to bypass said at least one geologic section in communication with said second portion of said well bore.

2. The well bore fluid redistribution assembly as described in claim 1, further comprising at least one geologic section having fluid communication with said first portion of said well bore below said well bore fluid redistribution apparatus.

3. The well bore fluid redistribution assembly as described in claim 2, wherein said at least one geologic section having fluid communication with said first portion of said well bore below said body produces said amount of liquid received by said first portion of said well bore below said body.

4. The well bore fluid redistribution assembly as described in claim 3, wherein said at least one geologic section having fluid communication with said first portion of said well bore below said body produces said amount of gas received by said first portion of said well bore below said first well bore fluid redistribution apparatus.

5. The well bore fluid redistribution assembly as described in claim 4, further comprising a second pump located outside of said well bore fluidicly coupled to said well outlet.

6. The well bore fluid redistribution assembly as described in claim 5, wherein said amount of gas is selected from the group consisting of: an amount of gas produced by a geologic section, an amount of gas produced by a coal zone, an amount of coal bed gas, an amount of coal bed methane gas, an amount of petroleum gas, an amount of a mixture of gases, and an amount of methane gas.

7. The well bore fluid redistribution assembly as described in claim 6, wherein said amount of liquid is selected from the group consisting of: an amount of liquid produced by a geologic section, an amount of liquid produced by a coal zone, an amount of coal bed liquid, an amount of a mixture of liquids, an amount of oil, and an amount of water.

8. The well bore fluid redistribution assembly as described in claim 7, further comprising a well bore seal element which circumferentially engages said body of said well bore fluid redistribution apparatus, said well bore seal element configured to engage said well bore to fluidicly isolate said first portion of said well bore below said body from said second portion of said well bore above said body.

9. The well bore fluid redistribution assembly as described in claim 8, wherein said well bore seal element has a plurality of attachment elements in the form of one or more circumferential rings which correspondingly couple with one or more circumferential grooves to hold said well bore seal element to said body.

10. The well bore fluid redistribution assembly as described in claim 9, wherein said well bore seal element has a configuration which removes from said body by upward movement of said body in said well bore.

11. The well bore fluid redistribution assembly as described in claim 1, wherein said bypass conduit permits said amount of gas to rise to said well outlet without a second pump located in said second portion of said well bore in fluid communication with said second port and said bypass conduit.

* * * * *